US005111910A

United States Patent [19]

Sheppard, Jr.

[11] Patent Number: 5,111,910

[45] Date of Patent: May 12, 1992

[54] OIL FILL TUBE INSERT

[76] Inventor: William A. Sheppard, Jr., 5128 McNamara Dr., Fredericksburg, Va. 22407

[21] Appl. No.: 640,611

[22] Filed: Jan. 14, 1991

[51] Int. Cl.[5] ..... F01M 11/04

[52] U.S. Cl. ..... 184/1.5; 184/105.1; 141/330; 156/69; 156/330

[58] Field of Search ..... 184/1.5, 105.1, 105.3; 141/329, 330, 98; 222/81, 88, 83.5; 156/69, 330

[56] References Cited

U.S. PATENT DOCUMENTS

| | | | |
|---|---|---|---|
| 1,028,542 | 6/1912 | Christian | 184/105.1 |
| 2,002,611 | 5/1935 | Nall | 141/330 |
| 2,661,500 | 12/1953 | Seymour et al. | 156/69 |
| 3,629,025 | 12/1971 | Walles | 156/330 |
| 4,289,255 | 9/1981 | Strampe | 141/330 |
| 4,415,387 | 11/1983 | Newman | 156/69 |
| 4,450,985 | 5/1984 | Beard | 222/83.5 |
| 4,606,470 | 8/1986 | Barlies | 156/69 |
| 4,746,381 | 5/1988 | Parker et al. | 156/69 |
| 4,846,236 | 7/1989 | Deruntz | 222/81 |
| 4,991,634 | 2/1991 | Tudek | 184/1.5 |

FOREIGN PATENT DOCUMENTS

| | | | |
|---|---|---|---|
| 0738173 | 7/1966 | Canada | 141/330 |
| 1420585 | 11/1965 | France | 141/329 |

*Primary Examiner*—Ira S. Lazarus
*Assistant Examiner*—Alan B. Cariaso
*Attorney, Agent, or Firm*—Leon Gilden

[57] ABSTRACT

An insert is arranged for mounting in association with an oil fill tube, such as typically utilized in internal combustion engines. The insert includes a cylindrical tube, with an annular collar coaxially and fixedly mounted to an upper terminal end of the tube. The collar receives the fill tube within an annular groove defined by the collar. A plurality of intersecting, triangular webs are fixedly mounted within the tube defining a coaxially oriented projecting and piercing tip to pierce an associated foil seal of conventional oil deposit and containers.

1 Claim, 4 Drawing Sheets

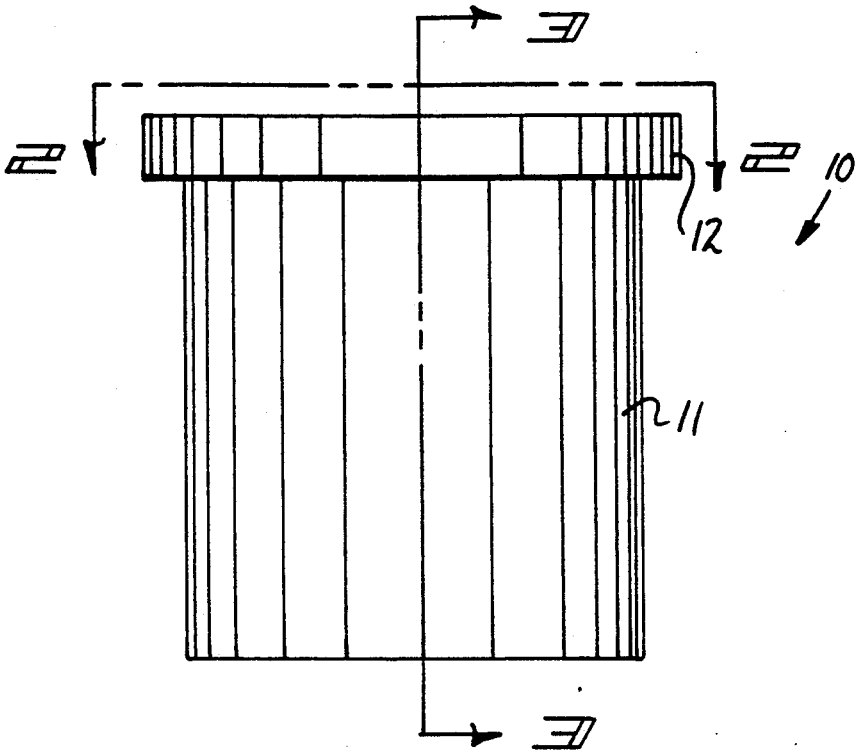
Fig 1
Fig 2
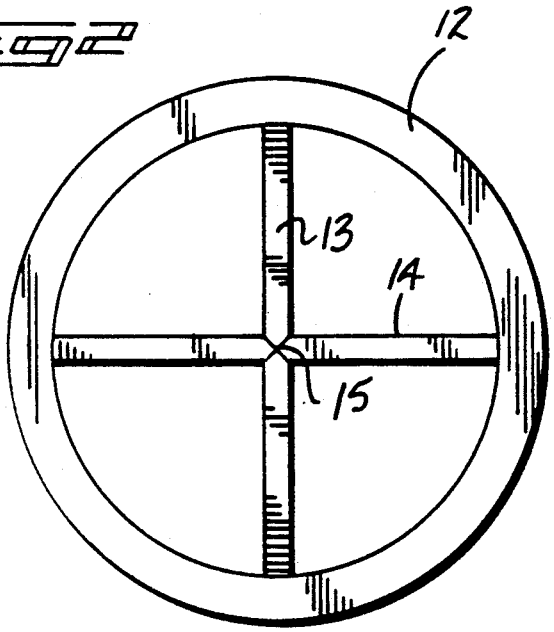

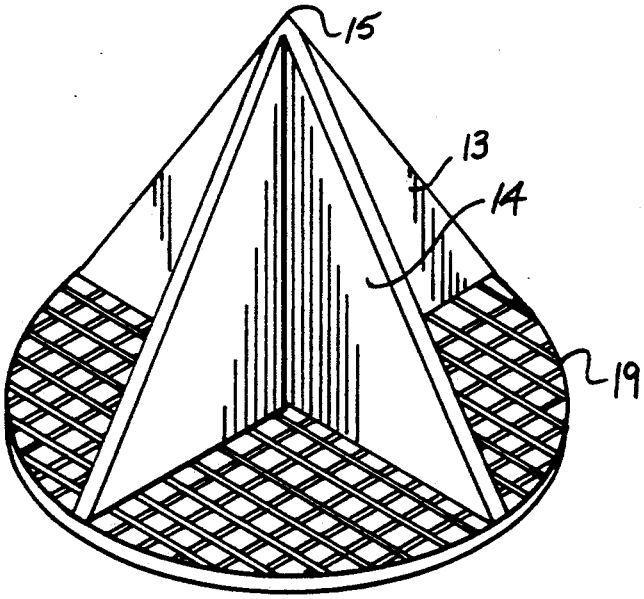
Fig 5
Fig 6
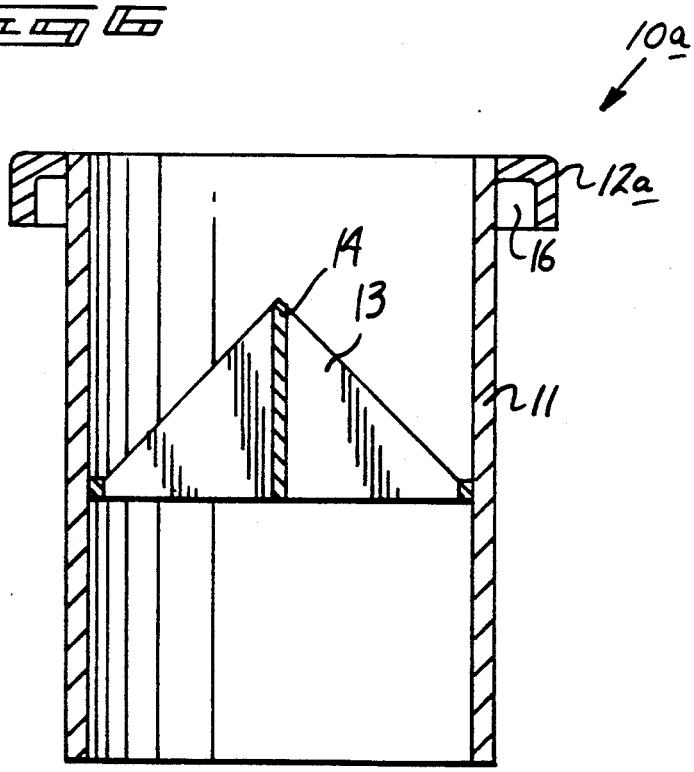

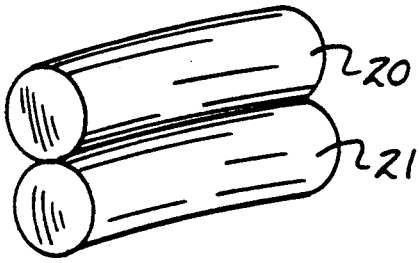
FIG 7
FIG 8
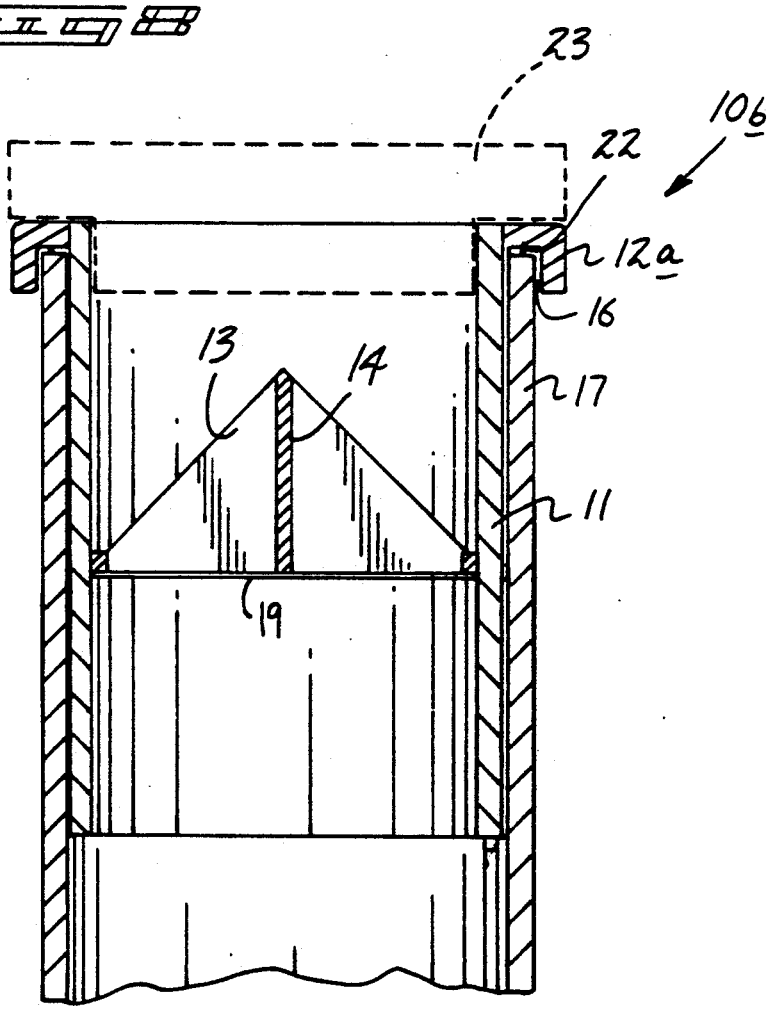

OIL FILL TUBE INSERT

BACKGROUND OF THE INVENTION

1. Field of the Invention

The field of invention relates to oil fill apparatus, and more particularly pertains to a new improved oil fill tube insert wherein the same provides convenient piercing and subsequent filling through an oil fill tube.

2. Description of the Prior Art

Conventional oil containers typically utilize a metallic foil type seal adhesively and fixedly secured to the spout of such containers. Consequently, oil filling requires initial puncturing of the seal and subsequent positioning of oil directed from the container through an oil fill tube frequently resulting in spillage of oil about an associated oil fill tube. Examples of prior art oil fill structure accordingly may be found in U.S. Pat. No. 4,746,023 to Belter setting forth a seal structure that is puncturable within a tubular shell to permit insertion of an oil line tube into an aperture in the housing of a vehicle engine.

U.S. Pat. No. 2,491,070 to Armstrong, et al. sets forth an example of an oil fill tube utilizing a removable lid mounted thereon provided with a puncturing tang.

U.S. Pat. No. 4,509,567 to Harrison, et al. sets forth an oil filter and cap structure that may be typically utilized in a resilient seal in a spring latch defined by the organization.

U.S. Pat. No. 1,641,269 to Hoke sets forth an oil cup structure permitting directing of oil therethrough.

U.S. Pat. No. 4,896,746 to Desjardians sets forth a covered storage funnel for use in directing oil into an associated internal combustion engine, wherein the funnel includes a serrated fill tube member.

As such, it may be appreciated that there continues to be a need for a new and improved oil fill tube insert as set forth by the instant invention which addresses both the problems of ease of use as well as effectiveness in construction in the directing of oil from a sealed container into an internal combustion engine and in this respect, the present invention substantially fulfills this need.

SUMMARY OF THE INVENTION

In view of the foregoing disadvantages inherent in the known types of oil fill tube apparatus now present in the prior art, the present invention provides an oil fill tube insert wherein the same permits mounting for subsequent puncturing of sealed oil containers permitting directing oil into an associated oil fill tube. As such, the general purpose of the present invention, which will be described subsequently in greater detail, is to provide a new and improved oil fill tube insert which has all the advantages of the prior art oil fill tube structures and none of the disadvantages.

To attain this, the present invention provides an insert for mounting in association with an oil fill tube, such as typically utilized in internal combustion engines. The insert includes a cylindrical tube, with an annular collar coaxially and fixedly mounted to an upper terminal end of the tube. The collar receives the fill tube within an annular groove defined by the collar. A plurality of intersecting, triangular webs are fixedly mounted within the tube defining a coaxially oriented projecting and piercing tip to pierce an associated foil seal of conventional oil deposit and containers.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the piblic generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oil fill tube insert which has all the advantages of the prior art oil fill tube structures and none of the disadvantages.

It is another object of the present invention to provide a new and improved oil fill tube insert which may be easily and efficiently manufactured and marketed.

It is a further object of the present invention to provide a new and improved oil fill tube insert which is of a durable and reliable construction.

An even further object of the present invention is to provide a new and improved oil fill insert which is susceptible of a low cost of manufacture with regard to both materials and labor, and which accordingly is then susceptible of low prices of sale to the consuming public, thereby making such oil fill tube inserts economically available to the buying public.

Still yet another object of the present invention is to provide a new and improved oil fill tube insert which provides in the apparatuses and methods of the prior art some of the advantages thereof, while simultaneously overcoming some of the disadvantages normally associated therewith.

Still another object of the present invention is to provide a new and improved oil fill tube insert wherein the same permits temporary or permanent mounting within an oil fill tube of an internal combustion engine permitting puncturing of a seal associated with an oil fill container and permitting subsequent mounting and positioning of the container relative to an oil fill tube and insert during an oil filling procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view of the instant invention.

FIG. 2 is a top plan view of the instant invention.

FIG. 5 is an isometric illustration of a modified puncturing web structure utilized by the instant invention.

FIG. 6 is an orthographic side view of a modified fill tube insert utilized by the instant invention.

FIG. 7 is an isometric illustration of adhesive rings utilized by the modified insert of the instant invention.

FIG. 8 is an orthographic side view, taken in elevation, of the modified insert of the instant invention utilizing the adhesive rings for permanent mounting of the insert relative to an associated oil fill tube.

DESCRIPTION OF THE PREFERRED EMBODIMENT

Figure 3:
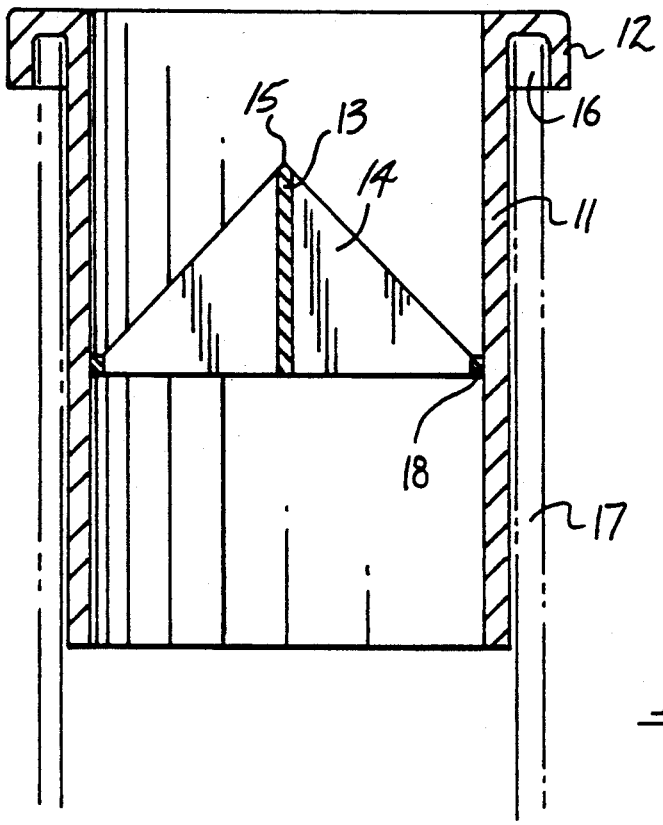
FIG. 3 is a cross-sectional illustration of the instant invention, taken along the lines 3—3 of FIG. 1 in the direction indicated by the arrows.

With reference now to the drawings, and in particular to FIGS. 1 to 8 thereof, a new and improved oil fill tube insert embodying the principles and concepts of the present invention and generally designated by the reference numerals 10, 10*a*, and 10*b* will be described.

Figure 4:
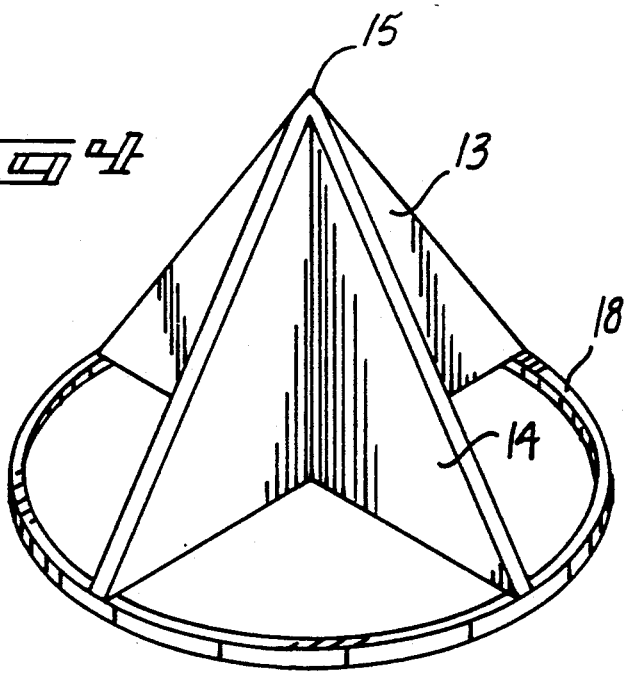
FIG. 4 is an isometric illustration of the puncturing web structure utilized by the instant invention.

More specifically, the oil fill tube insert apparatus 10 of the instant invention essentially comprises a cylindrical tube 11 defined by a first diameter fixedly mounting a cylindrical collar 12 defined by a second diameter greater than the first diameter at an upper terminal end of the tube 11, with the tube and collar coaxially aligned relative to one another. Reference to FIGS. 2-8 illustrate the puncturing and positioning mechanism of the instant invention, wherein a first isosceles triangular web 13 and a second isosceles triangular web 14 are fixedly and orthogonally mounted relative to one another. Each web 13 and 14 is diametrically aligned relative to the cylindrical tube 11 and positioned below the upper terminal end of the tube 11 to receive a pouring spout (not shown) of an oil container within the tube 11. Further, the triangular webs provide positioning of an associated pouring spout mounted thereon to enhance containment and alignment of the pouring spout therewithin. It should be further noted that the triangular webs 13 and 14 that bisect one another, in a manner as illustrated in FIG. 4 for example, provide self-alignment of a pouring spout directed thereover. The first and second webs 13 and 14 respectively define a coaxially aligned piercing tip 15 to pierce an associated foil web typically utilized in conventional oil filling containers. The collar 12 defines an annular groove 16 between the collar and the upper terminal end of the cylindrical tube 11 to receive a cylindrical oil fill tube 17 therewithin. The cylindrical oil fill tube 17 is defined by a predetermined internal diameter substantially equal to the first diameter of the tube 11, and wherein the fill tube 17 is formed of a predetermined wall thickness substantially less or equal to the predetermined width of the groove 16 to receive the groove 16 therewithin, in a manner as illustrated in FIGS. 3, 6, and 8.

The first and second webs 13 and 14 are mounted at their peripheral apex corners to a mounting ring 18, wherein the mounting ring 18 is defined by a diameter substantially equal to an internal diameter of the tube 11 to permit unitary positioning of the webs and mounting ring within the tube an assembly procedure. Alternatively, the mounting ring 18 may be substituted by a screen disk 19 to provide filtration of oil directed therethrough minimizing contamination of oil directed into an internal combustion engine.

FIG. 6 illustrates a modified insert 10*a*, wherein a modified collar 12 is formed of a ferromagnetic material defining a magnetic cylindrical collar 12*a* to enhance securement and positioning of the collar overlying the fill tube 17.

FIGS. 7 and 8 illustrates a further modified fill tube insert 10*b* wherein an epoxy resin tubular ring 20 is mounted in contiguous relationship to an epoxy hardener ring 21 mounted within the annular groove 16, whereupon projection of the collar 12 onto the tube 17 and reception of the tube 17 within the groove 16 effects mixing of the resin ring 20 and the hardener ring 21 to define an adhesive mixture 22 to provide permanent securement of the modified insert 10*b* to the fill tube 17. A covering cap 23 is subsequently provided to cover an upper opening of the insert 10*b* subsequent to use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oil fill tube insert in combination with a cylindrical oil fill tube, the cylindrical oil fill tube defined by a predetermined internal diameter, and wherein the cylindrical oil fill tube is further defined by a predetermined wall thickness, and the insert comprises, a cylindrical tube, the cylindrical tube defined by a first diameter less than equal the first diameter of the oil fill tube, and a cylindrical coolar fixedly mounted to an upper terminal end of the cylindrical tube, the cylindrical tube and the cylindrical collar coaxially aligned relative to one another, and the cylindrical collar defining an annular groove between the cylindrical collar and the cylindrical tube, and piercing means coaxially mounted within the cylindrical tube below the upper terminal end of the cylindrical tube, and wherein the piercing means includes a first isosceles triangular web intergrally and orthogonally mounted to a second isosceles triangular web, the first and second isosceles triangular webs are each diametrically aligned to the cylindrical tube and define a piercing tip coaxially aligned with the cylindrical tube at an upper terminal end of an intersection defining the first triangular web mounted to the second triangular web, and wherein the first triangular web and the second triangular web are mounted to a mounting ring, the mounting ring defined by a mounting ring diameter substantially equal to an internal tube diameter defined by the cylindrical tube, and the mounting ring fixedly mounted to outer peripheral apex portions of each of the first and second webs, and wherein a screen disk is coextensively mounted within the mounting ring, and wherein an epoxy resin tubular ring is mounted within the annular groove in contiguous association with an epoxy hardner ring mounted within the annular groove permitting an adhesive mixture to be formed by mounting of the annular groove overlying the oil fill tube, and wherein the insert further includes a covering cap positionable within the cylindrical collar.

* * * * *